United States Patent [19]

Shippell

[11] 4,373,637

[45] Feb. 15, 1983

[54] COLLAPSIBLE PALLET MOUNTED CONTAINER

[75] Inventor: Joseph C. Shippell, Montrose, Mich.

[73] Assignee: Consolidated Packaging Corporation, Flint, Mich.

[21] Appl. No.: 325,579

[22] Filed: Nov. 30, 1981

[51] Int. Cl.[3] ..... B65D 19/00

[52] U.S. Cl. ..... 206/600; 229/41 B

[58] Field of Search ..... 206/386, 340, 600; 229/6 R, 23 R, 41 B; 108/53.1, 53.3, 53.5

[56] References Cited

U.S. PATENT DOCUMENTS

| | | | |
|---|---|---|---|
| 2,285,786 | 6/1942 | Vera | 229/41 B |
| 2,680,557 | 6/1954 | Madden | 229/41 B |
| 2,761,609 | 9/1956 | Arkin | 229/41 |
| 2,898,029 | 8/1959 | Sherman | 229/41 |
| 2,902,199 | 9/1959 | Breton | 206/386 |
| 3,026,015 | 3/1962 | Severn | 229/41 |
| 3,036,752 | 5/1962 | Elliott | 206/386 |
| 3,119,547 | 1/1964 | Nute | 229/41 |
| 3,291,364 | 12/1966 | Fischer | 229/6 |
| 3,519,190 | 1/1970 | Achermann et al. | 229/37 |
| 3,743,166 | 7/1973 | Heavner | 229/23 R |
| 3,949,874 | 4/1976 | Heavner | 206/386 |
| 4,085,846 | 4/1978 | Williams | 206/600 |
| 4,119,205 | 10/1978 | Delany | 206/600 |

*Primary Examiner*—Joseph Man-Fu Moy
*Assistant Examiner*—David Fidei
*Attorney, Agent, or Firm*—Knechtel, Valentino, Demeur & Dallas

[57] ABSTRACT

A collapsible corrugated fiberboard container to be fastened to a pallet. The container has a floor panel, two opposite side panels and two opposite end panels. The side panels and end panels are flexibly connected to each other, and the floor panel is connected to the bottom edges of the side panels. The floor panel is divided by score lines into a center portion and two outer portions which are on either side of the center portion. The center portion is attached to the pallet, and the outer portions are free to pivot about the score lines. The end panels are provided with vertical score lines. Bottom flaps are each connected to the bottom edge of the end panels and are also provided with score lines. The container can be collapsed due to the flexible connections between the side and end panels and the arrangement of the score lines so that the container can assume a flattened storage configuration above the pallet when not in use.

13 Claims, 7 Drawing Figures

COLLAPSIBLE PALLET MOUNTED CONTAINER

BACKGROUND OF THE INVENTION

This invention relates to a collapsible container which is designed to be mounted to a pallet, and particularly to a collapsible container which is designed to collapse and be folded in a flattened configuration above the pallet for storage.

It has always been the common practice in shipping and storage to utilize various containers generally manufactured of corrugated fiberboard which are attached to a pallet. The pallets are generally manufactured of wood which is mounted on skids so that forklifts can approach the pallet in any one of four directions and quickly and easily move the pallet. Such assemblies generally required a carton and pallet, each separate units. This necessitated assembly of the container and mounting it on the pallet for use. A great deal of storage area was taken up if the containers were to be stored for reuse. The containers sometimes were knocked down or destroyed, in which case only the wooden pallets were reused.

Collapsible containers for use with pallets have previously been designed. However, these containers had the side walls or end walls collapsible, while the entire bottom of the container has been either totally affixed to the pallet or completely removable therefrom.

One type of palletized container had the container and pallet both made from corrugated fiberboard or the like with the pallet formed from the same blank as the container. Examples can be seen in U.S. Pat. No. 3,026,015 to Severn and U.S. Pat. No. 3,519,190 to Achermann et al. Both of these patents illustrate a container having a pallet integrally formed with the container and able to be knocked down or folded for storage. Such containers have a serious disadvantage in that one purpose of a palletized container is to contain bulky or heavy objects with the entire pallet and container capable of being moved by generally available lift trucks having forks extending from the front. A corrugated fiberboard pallet can easily be pierced by the forks of the lift truck and has limited strength and durability.

Another disadvantage of containers which have a pallet as a part thereof is that they require a great deal of assembly time and frequently more than one person to assemble them. This severely lessens their desirability for use. Furthermore, the palletized containers having an integrally formed pallet can generally be approached with a forklift from only two sides. This is an undesirable feature in a crowded warehouse where it is, at times, necessary to be able to approach a pallet from any one of four directions. Most commercially available pallets have this capability and operators of lift trucks have become accustomed to this characteristic.

Another container which makes use of a standard pallet is illustrated in U.S. Pat. No. 4,085,846 to Williams. Although a standard pallet is used, the container is floorless and relies on a floor formed separately and attached to the pallet. This can result in a weakened container. The bottom floor generally adds structural support to the containers by keeping the side walls or end walls of the container from bulging outward and separating from the floor. The Williams design does not provide for this support and the side walls can separate from the floor.

A last design which uses a standard pallet is illustrated in U.S. Pat. Nos. 3,743,166 and 3,949,874, both issued to Heavner. In both of the Heavner patents the container is hingedly connected along one edge to an edge of a pallet. The container pivots around this edge either to a usable or storage position. A problem with the design shown in the '166 patent is that the surface area taken up by the container in the stored position is more than when in the opened position. This is due to the container pivoting away from the top of the pallet and thus takes almost twice the opened amount of surface area for storage. Thus, although the container is collapsed and takes less than the height which the assembled container takes, the storage configuration may still be unacceptable. Also, the Heavner design requires substantial time, effort and manpower to assemble the carton due to the numerous folds which must be made to assemble the completed carton.

In all of the prior art containers utilizing pallets, the pallets are either stored separately or, if they are of a unitary structure, they are of a combined container and corrugated fiberboard pallet design. The corrugated fiberboard pallets do not have the strength or access to forklifts that the conventionally designed wooden pallets have. Another disadvantage is that the corrugated fiberboard palletized unitary designs require substantial assembly time and manpower before they can be used, or knocked down if they are to be stored for reuse. Furthermore, the storage configuration of prior devices still requires a substantial amount of surface area to store the collapsed cartons.

SUMMARY OF THE INVENTION

It is thus an object of the present invention to provide a novel container which can be used with several different types of pallets. Similarly, an object of the invention is to provide a container which can be affixed to the top of a wooden pallet designed for reuse, or an inexpensively assembled corrugated fiberboard pallet designed for disposal.

Another object is to provide a collapsible container which can be opened or collapsed easily by one person. A related object is to provide a collapsible container with the minimum number of fold or score lines required to achieve the object of simple and easy opening and closing.

A further object of this invention is to provide a collapsible container which generally occupies approximately the same surface area in the collapsed position as it does when in the opened position. This results in a collapsed container occupying a minimal amount of storage area when in the collapsed storage position.

Another object is to provide a collapsible container which can be alternately stacked in a pile after collapsing the container so that several containers can be placed on top of one another thereby reducing the storage area required for collapsed containers.

Yet another object is to provide a collapsible container which is inexpensive to manufacture due to the material it is constructed from and also due to the manner in which it is constructed.

Finally, an object is to provide a container which can be removed when it is no longer functional from a reusable pallet and a new container affixed to the same pallet thereby allowing a reusable pallet of sturdy construction to be used with several collapsible containers.

Other objects and advantages of the invention will become apparent upon reading the detailed description and upon reference to the drawings.

The foregoing objects are accomplished by providing a collapsible container which is formed from corrugated fiberboard and is adapted to be fastened to a pallet. The rectangular container body is formed from a floor panel, side panels and end panels. There are two parallel score lines which divide the floor panel into a center portion and two outer portions which are adjacent the side panel bottom edges. The center portion of the floor panel is fastened to the top of the pallet and the outer portions are foldable along the score lines. The outer portions are flexibly connected to the bottom edges of the side panels. There are two bottom flaps each flexibly connected to the bottom edges of the end of the panels. A vertical scored line bisecting the end panel also bisects the bottom flaps. When the container is in its opened position, the bottom flaps lie on top of the floor panel to give the floor of the container a multiple ply reinforced bottom. When the container is collapsed, the bottom flaps fold upward against the side panels, and the side panels and bottom flaps fold together along the score line inwardly in unison. Also, when the container is in the opened position, the outer portions are flush against the pallet top; when the container is in the collapsed position, the outer portions are folded upward about the score lines until they are folded inward above the center portion of the floor. Due to the configuration of the score lines, bottom flaps, and floor panel, the container can be collapsed to a flattened storage configuration above the pallet.

DESCRIPTION OF THE DRAWINGS

The invention will now be described by way of example and with reference to the accompanying drawings.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DESCRIPTION OF THE PREFERRED EMBODIMENT

Figure 1:
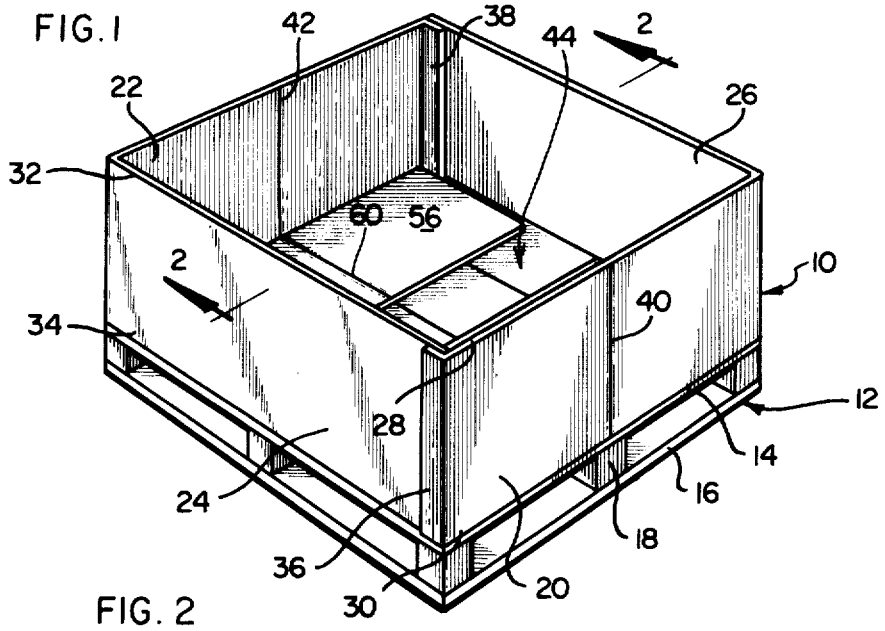
FIG. 1 is a perspective view of the collapsible container assembly and pallet of the present invention.
Figure 2:
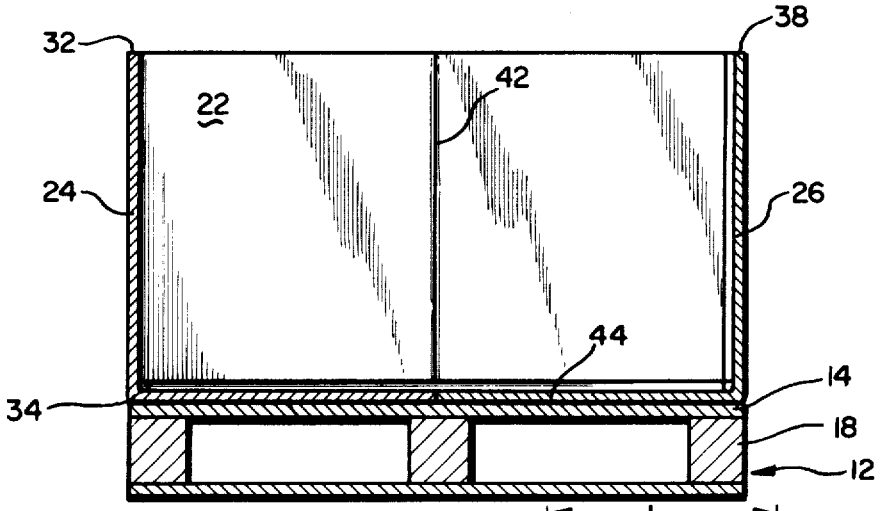
FIG. 2 is a cross-sectional view taken along lines 2—2 of FIG. 1.

Turning first to FIGS. 1 and 2, there is illustrated a collapsible container 10 affixed to a horizontal rigid pallet 12. The pallet 12 is of conventional design having a top 14 and bottom 16 separated by supports 18. The top and bottom can be made of either solid sheets of wood or slats. The spacing between supports 18 is such as to allow the entrance of forks from a lift truck to be placed between the top 14 and bottom 16 from any one of the four sides of the pallet 12. Although wood is the preferred material to manufacture the pallet 12, other materials such as cardboard, foamed plastic, or other rigid materials could be used.

The container 10 has four flexibly interconnected wall panels illustrated as two opposite end panels 20 and 22, and two opposite side panels 24 and 26. Each end panel has top and bottom edges 28 and 30. Each side panel has top and bottom edges 32 and 34. Flexible connections at the bottom edges 30 and 34 are made by scoring and folding the container material to form the bottom of the container, as will be more fully described below. A flexible connection at each of the corners can be accomplished by scoring and folding the container material when forming the container from one continuous piece, or by flexibly joining two separate panels. The flexible connections in the preferred design between panels 22 and 24, and 26 and 20 were made by scoring and folding the corrugated fiberboard container material. The flexible connection between end panels 20, 22 and their respective side panels 24, 26 were made with the addition of corner flaps 36, 38. The connection between the flap and end panel was made by scoring and folding to form the flaps 36, 38 and then stitching or gluing the flaps to the side panels 24 and 26. Although stitching is preferred, glue, tape or other equivalent adhesives could be used.

All of the panels have inner and outer surfaces, the inner surface of a panel being that side located towards the center of the container 10, and the outer surface on the opposite side.

The end panels 20, 22 have a vertical score line 40, 42 extending between the top edge 28 and bottom edge 30 of their respective side panels 20 and 22. The purpose of the vertical score lines will be discussed in detail below.

Figure 4:
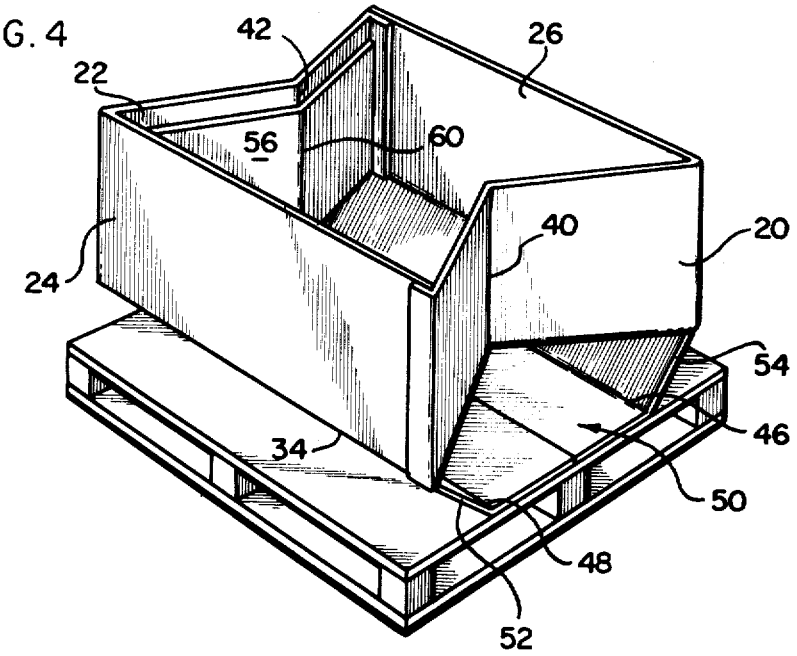
FIG. 4 is a perspective view of the collapsible container in the partially collapsed position.
Figure 6:
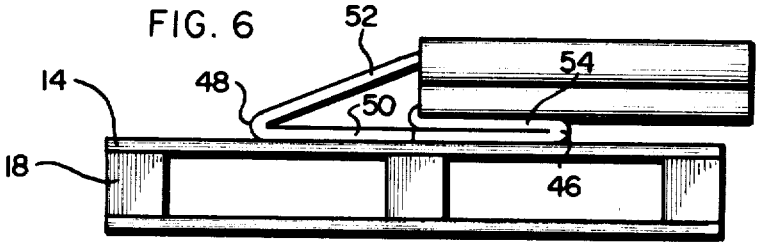
FIG. 6 is an end view of the container and pallet with the container in the fully collapsed storage position.
Figure 7:
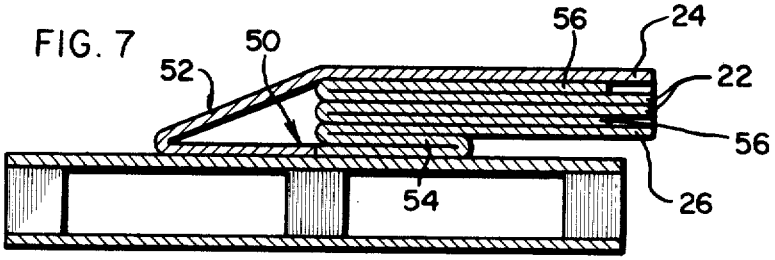
FIG. 7 is a cross-sectional end view of the collapsed container illustrated in FIG. 6, and taken along a line similar to line 2—2 of FIG. 1.

The container 10 has a floor 44 which is affixed at specific locations to the top 14 of the pallet 12 after being centered. As better seen in FIG. 4, the floor 44 is divided by score lines 46 and 48. This divides the floor 44 into a central portion 50, and outer portions 52 and 54. The central portion is defined as the area between the two score lines 48 and 50; the outer portions are the floor areas bounded by the score lines 46, 48 and the bottom edges 34 of the side panels 24 and 26. As seen in FIGS. 4, 6 and 7, the central portion 50 is the only portion of the floor 44 which is fastened to or affixed to the top 14 of the pallet 12. The method of fastening can be adhesives or glues, but it would be most practical to use staples which could easily pass through the corrugated fiberboard floor 44 and be driven into the top 14 of the pallet 12. This would also permit the container to be easily removed and replaced with a new container when desired.

The score lines 46 and 48 are parallel to each other and parallel to the bottom edge 34 of the side panels 24, 26. The connection between the outer portions 52, 54 and the side panels 24, 26 is also a flexible connection which can easily be accomplished by means of scoring and folding a continuous piece of corrugated fiberboard. Again, if separate corrugated board pieces are used, stitching would be preferred.

Flexibly connected to the bottom edge 30 of the end panels 20, 22 are bottom flaps 56, 58 which lie on top of floor 44 when the container is erected. The bottom flap 56 is bisected by a score line 60 which extends perpendicular from the bottom edge 30 of the end panel 22 and extends from the end panel 22 to the end of the bottom flap 56. The scoreline 60 forms an extension of the vertical score line 42, as can be best seen in FIG. 3. Bottom flap 58 also is bisected by a similar score line 62 which forms an extension of the score line 40 and extends from the end of the bottom flap 58 to the flexible connection between the bottom flap 58 and the end panel 20.

Figure 3:
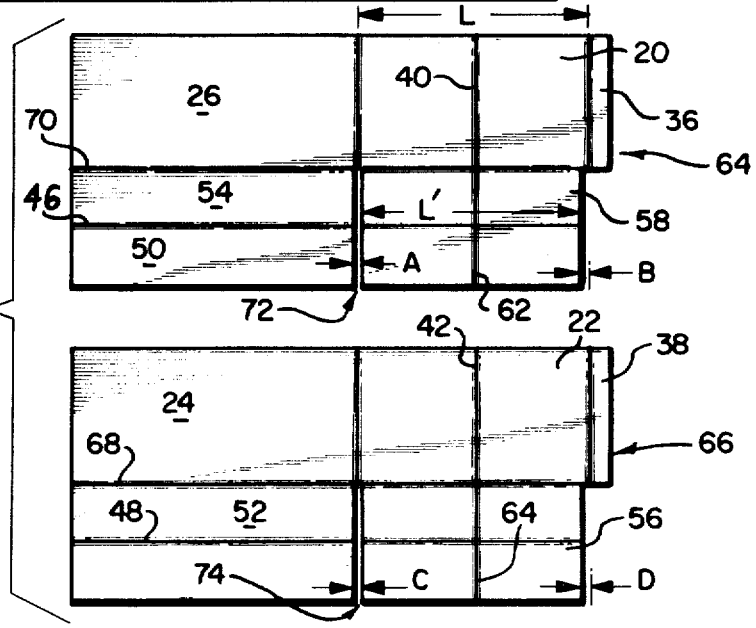
FIG. 3 is a plan view of two blanks used to construct the collapsible container illustrated in FIG. 1.

The container 10 can be manufactured from a single blank or two or more blanks. FIG. 3 illustrates two similar blanks 64, 66, used to manufacture the container 10 illustrated in FIG. 1. It can be seen that the vertical score line 40, 42 bisects the end panels 20, 22, respectively. The flexible connections between the side panels 24, 26 and the outer portions 52, 54 are made by means of score lines 68, 70, respectively. Score lines 70 and 68 extend to flexibly connect the end panels 20, 22 to the bottom flaps 58, 56, respectively. The score lines 60, 62 bisect the bottom flaps 56, 58 and are in alignment with the vertical score lines 42, 40, respectively. Due to generally available manufacturing equipment, the score lines 46 and 48 extend across and score the bottom flaps 56, 58, but the flaps 56 and 58 are not folded on these extended score lines.

The container 10 is generally manufactured at a central manufacturing location which assembles the blanks 64, 66 into containers which are fastened to the pallet 12. The flap 36 is affixed by stitching it to the edge of the side panel 24. Alternatively, it can be glued or otherwise affixed to the side panel 24. The flap 38 is glued on one surface and affixed to the edge of the side panel 26. The blanks are then folded along all score lines and the central portion 50 is positioned and preferably stapled to the top 14 of the pallet 12.

As seen in FIG. 3, the blank 64 has a gap 72 between the side of the bottom flap 58 and the edge of the combined central portion 50 and outer portion 54. Similarly, blank 66 has a gap 74 between the edge of the bottom flap 56 and the combined central portion 50 and outer portion 52. The gap distance is identified as "A" on blank 64 and "C" on blank 66. The end panels 20, 22 have a length indicated as "L". The bottom flaps 58, 56 have a length "L'". The length of the panels "L" is longer than the length of the bottom flaps "L'" with the end panels extending at each side slightly beyond the bottom flaps. This provides some clearance between the bottom flaps 56, 58 and the side panels 24, 26 when assembling the container to the opened position. The overlap on the right side of the blank in FIG. 3 is identified as "B", and on the blank 66 is identified as "D" and the amount of the extension of the end panel 20 passed the bottom flap 58 is identical on each side. Thus, "A", "B", "C" and "D" are all equal dimensions. This clearance between the bottom flaps and the side panels is also desirable when the container is to be collapsed as will be described below.

Figure 5:
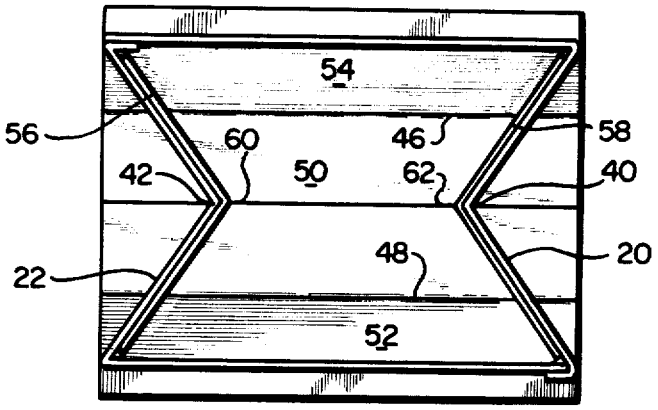
FIG. 5 is a plan view of the container shown in FIG. 4 in the partially collapsed position.

To collapse the container of FIG. 1, the bottom flaps 56, 58 which are oriented above and in contact with the floor 44, are raised along their respective score lines 68,70 until the top surface of the bottom flaps contacts the inner surface of the end panels 22, 20, as can be better seen in FIGS. 4 and 5. The end flaps 20, 22 are then folded inwardly along the vertical score lines 40, 42, which are in alignment with the score lines 62, 60 of the bottom flaps 58,56. The end panels and bottom flaps are folded together in unison until the flaps and panels are collapsed and in contact with another flap or panel. This can be more clearly seen in FIGS. 6 and 7.

Simultaneous with the inward folding of the end panels and bottom flaps, the outer portions 52, 54 are pivotally raised up from their contact with the top 14 of the pallet 12. The outer portions fold along their respective score lines 48, 46 until the outer portions are above the central portion 50 and the flaps and panels are collapsed. The side walls, folded end walls and bottom flaps are then pushed to either side of score line 46 or 48 and folded back over one of the score lines 68. The collapsed walls of the container are stored in a substantially horizontal plane which is parallel to the plane of the top of the pallet. As seen in FIG. 7, the collapsed walls can be stored with equal ease on either side of the pallet, and is only dependent upon which score line the user wishes to fold the collapsed walls around. By moving the score lines on portions 52, 54, the container can be designed so that most, if not all, of the collapsed container lies above the pallet top and does not overlap the edges of the pallet when in the collapsed, stored position. This is seen in FIGS. 6 and 7 where substantially all of the container 10 is stored above the pallet top 14. There is very little overhang which is a desirable characteristic as the surface area taken up by the collapsed pallet can be kept to a minimum. It can be also seen that collapsed containers can be stored one on top of the other in a stack.

The height of the container 10 is determined by the distance between the top and bottom edges of the end panels and side panels. The illustrated embodiment formed the container 10 from two corrugated blanks 64, 66. However, the container could be manufactured from one blank or more than two if desired. This would depend on the manufacturing equipment available, the needs of the user and other manufacturing variables.

The container could also be manufactured with a top by a simple addition of flaps above the end panels 20, 22 and side panels 24, 26. Should a top integral with the container be desired, the score lines would have to line up with the vertical score line such that the top would also be collapsible. If a top which is not integral with the container is desired, then a pre-manufacured, preformed top can be placed over the top of the container when assembled.

Thus, it is apparent that there has been provided, in accordance with the invention, a collapsible pallet mounted container that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

I claim:

1. A collapsible container assembly comprising:

a horizontal rigid pallet base;

four flexible interconnected wall panels comprising two opposite side panels and two opposite end panels;

a container floor with at least two floor score lines parallel to each other dividing the floor to define a central portion and outer portions of each side of and connected to the central portion;

the container floor being integrally and flexibly connected at the outer edges of the outer portions to the bottom edges of the two opposite side panels by means of a pair of side score lines;

the central portion being affixed to the rigid pallet and the outer portions being foldable along the floor and side score lines;

vertical score lines dividing the two opposite end panels into two sections, whereby the two sections on each side of the vertical score lines on each of the two opposite end panels are foldable inwardly along the vertical score lines from an opened position to a collapsed position;

the floor score lines and the side score lines and the vertical score lines all forming flexible connections allowing the container to be collapsed in a flattened configuration above the pallet for storage.

2. The collapsible container of claim 1 and further comprising two bottom flaps each flexibly connected along one of its edges to the lower edge of one of the two opposite end panels and adapted to be positioned over the container floor to provide a second ply reinforced floor for the container.

3. The collapsible container of claim 2 wherein the two bottom flaps have a bottom score line aligned with the vertical score lines on the two opposite end panels so that when the container is collapsed, the bottom flaps are foldable upwardly by means of the flexible connections until the bottom flaps are facing the end panel, to which it is connected and then foldable inwardly along the bottom and vertical score lines in unison with the two opposite end panels.

4. The collapsible container of claim 1 and further comprising at least two top flaps each flexibly connected along one edge to the top edge of two opposite wall panels.

5. The collapsible container of claim 4 and further comprising two additional top flaps each flexibly connected along one edge to the top edge of the remaining two opposite wall panels.

6. The collapsible container of claim 2 wherein the container is formed from two blanks of the same size, each blank having a side panel, end panel, bottom flap and half the container floor.

7. The collapsible container of claim 6 and further comprising connecting means between the blanks whereby the blanks can be fastened together.

8. The collapsible container of claim 7 wherein the connecting means comprises corner flaps on one blank and fastening means to affix the corner flaps to the other blank.

9. The collapsible container of claim 2 wherein the bottom flaps are polygonal with their length in the direction of the edge which is flexibly connected to the end panel and side edges perpendicular to the length, with the end panels having a height defined by the top and bottom edges of the end panel and a length perpendicular to the height and defined by the interconnections with the side panels, the length of the end panels longer than the length of the bottom flaps, and the end panels extending beyond the bottom flaps to provide clearance between the side edges of the bottom flaps and the interconnections between the end panels and side panels when the container is collapsed.

10. The collapsible container of claim 1 wherein the container is formed of corrugated paper board.

11. The collapsible container of claim 3 wherein the vertical score lines divide the two opposite end panels into two equal sections and the two bottom flaps are divided into two equal sections by their score lines.

12. A collapsible container to be fastened to a pallet, the container formed from corrugated paper board and comprising:

a polygonal carton body formed from a floor panel, two opposed side panels and two opposed end panels, the side and end panels having top and bottom edges;

the side panel bottom edges being integrally and flexibly connected to the floor panel;

the floor panel divided by two parallel score lines into a central portion bordered by the two score lines and two outer portions bordered on one edge by the score line and the other edge by the side panel bottom edge;

the central portion affixed to the pallet and the outer portions foldable along the two parallel score lines from a container's opened position, in which the outer portions are in face-to-face contact with the pallet base, to a container collapsed position, in which the outer portions are folded along the score lines;

the end panels flexibly connected to the side panels, and bisected by a vertical end panel score line extending from the top to the bottom edge, two end panel portions formed by the vertical score line which lie in the same plane when the container is in the opened position, and foldably inward along the vertical score line until the outside surface of the two end panel portions are in face-to-face contact when in the container collapsed position;

two bottom flaps each flexibly connected to one of the bottom edges of the end panels;

the bottom flaps bisected by a bottom flap score line which is contiguous and aligned with the vertical score line;

the bottom flaps oriented above and in contact with the floor panel when the container is in the opened position, and foldable upward by means of the flexible connection to the bottom edges, until the surface of the bottom flaps contacts the inner surface of the end panels, the bottom flaps then foldable inwardly along the bottom flap score lines in unison with the inward folding along the vertical score lines of the end panels when in the container collapsed position, whereby the opened rectangular container can be collapsed to a flattened storage configuration above the pallet for storage.

13. The container of claim 12 characterized by the bottom flaps when folded upward against the end panels maintain a clearance gap between the edges of the bottom flaps and the side panels when the container is in the opened or collapsed configuration.

* * * * *